US005948859A

United States Patent [19]

Sano et al.

[11] Patent Number: 5,948,859

[45] **Date of Patent: *Sep. 7, 1999**

[54] THREAD WOUND GOLF BALL

[75] Inventors: Yoshinori Sano; Akira Kato, both of Shirakawa, Japan

[73] Assignee: Sumitomo Rubber Industries, Ltd., Hyogo-ken, Japan

[ * ] Notice: This patent is subject to a terminal disclaimer.

[21] Appl. No.: 08/764,076

[22] Filed: Dec. 6, 1996

[30] Foreign Application Priority Data

Dec. 7, 1995 [JP] Japan ..... 7-345658

[51] Int. Cl.[6] ..... A63B 37/12

[52] U.S. Cl. ..... 525/71; 525/74; 473/359; 473/365

[58] Field of Search ..... 473/359, 365; 525/71, 74

[56] References Cited

U.S. PATENT DOCUMENTS

| | | | |
|---|---|---|---|
| 5,543,467 | 8/1996 | Hamada | 525/221 |
| 5,631,324 | 5/1997 | Rajagopalan | 525/221 |

FOREIGN PATENT DOCUMENTS

| | | |
|---|---|---|
| 0557069 | 8/1993 | European Pat. Off. . |
| 0652254 | 5/1995 | European Pat. Off. . |
| 674923 | 10/1995 | European Pat. Off. . |
| 072573 | 4/1985 | Japan . |
| 2134798 | 8/1984 | United Kingdom . |
| 2239458 | 7/1991 | United Kingdom . |
| 2296497 | 7/1996 | United Kingdom . |

*Primary Examiner*—David Buttner
*Attorney, Agent, or Firm*—Birch, Stewart, Kolasch & Birch, LLP

[57] ABSTRACT

A thread wound golf ball having good shot feel and controllability as well as excellent flight performance which comprises a center composed of a vulcanized molded article of a rubber composition, a thread rubber layer formed on the center and a cover covering the thread rubber layer, wherein the center has a diameter of from 30 to 38 mm and a deformation amount, formed by applying an initial load of 10 kg to a final load of 30 kg to the center, of from 1 to 2.5 mm and the cover is formed from a heated mixture of an ionomer resin, an maleic anhydride-modified thermoplastic resin and an epoxidated thermoplastic resin having a JIS-A hardness of 30 to 90.

9 Claims, 1 Drawing Sheet

THREAD WOUND GOLF BALL

FIELD OF THE INVENTION

The present invention relates to a thread wound golf ball. More particularly, it relates to a thread wound golf ball having good shot feel (feeling at the time of hitting) and good controllability as well as excellent flight performance.

BACKGROUND OF THE INVENTION

Recently, an ionomer resin has widely been used for the cover of a golf ball (e.g. Japanese Patent Publication Sho 49-49727). Particularly, the ionomer resin is exclusively used in a two-piece solid golf ball composed of a solid core and a cover covering the solid core, because the ionomer resin is superior in processability, durability, cut resistance and rebound characteristics compared to other reins used for golf ball covers.

However, the ionomer resin is poor in shot feel and controllability (ease of putting spin on the ball) compared to a balata cover (transpolyisoprene) which has been used as a cover for a thread wound golf ball because ionomer resins are too hard and too rigid. In a golf ball using an ionomer resin for the cover, a sharp metallic "click" sound emits at the tie of contacting the ball with a golf club. This sharp metallic "click" sound is shunned by professional golfers and high-level amateur golfers, because such a sound is unpleasant to the professional golfer or to high-level amateur golfers.

Japanese Laid-Open Patent Publication Hei 1-308557 suggests that an ionomer resin is softened by blending (mixing) a soft ionomer resin of a sodium or zinc salt of a terpolymer comprising an olefin having 2 to 8 carbon atoms, an unsaturated monocarboxylic acid having 3 to 8 carbon atoms and an acrylate having 2 to 22 carbon atoms with an ionomer resin to improve the shot feel and controllability. However, when the above soft ionomer resin is so blended, the shot feel and controllability are improved but the flight performance and cut resistance are adversely degraded.

Japanese Laid-Open Patent Publication Hei 5-220240 suggests that an ionomer resin is softened by blending a glycidyl group-containing polymer therewith. However, satisfactory results have not been obtained in flight performance, because the selection of the a base polymer of the glycidyl group-containing polymer is difficult.

In addition to the above trials, various trials of softening the ionomer resin to improve shot feel and controllability have been made, but satisfactory results have not been obtained at present. Accordingly, a golf ball having satisfactory performances is still desired.

On the other hand, the thread wound golf ball is basically composed of a solid or liquid center, a thread rubber layer formed by winding a thread rubber around the center and a cover for covering the thread rubber layer. Such a ball is excellent in shot feel and controllability in comparison with the two-piece solid golf ball using a solid core The thread wound golf ball, however, is poor in flight distance in comparison with the two-piece solid golf ball because of the large amount of spin and the low launch angle.

SUMMARY OF THE INVENTION

As a result of intensive investigation, it has been found that a thread wound golf ball having good shot feel and controllability as well as excellent flight performance is obtained by increasing the diameter of the center, imparting a proper hardness to the center and using a resin mixture as the cover which is obtained by adding a maleic anhydride-modified thermoplastic resin as a soft component and an epoxy group-containing soft epoxidated thermoplastic resin having reactivity with both components to the ionomer resin, followed by mixing with heating.

Therefore, it is the main objective of the present invention to solve the above problems by providing a golf ball having good shot feel and controllability, with which professional and high-level amateur golfers are satisfied, as well as excellent flight performance which attains the same flight distance as that of the two-piece golf ball, without substantially deteriorating the other characteristics of the ionomer resin.

BRIEF EXPLANATION OF THE DRAWINGS

The present invention will become more fully understood from the detailed description given hereinbelow and the accompanying drawings which are given by way of illustration only, and thus are not limitative of the present invention, and wherein.

SUMMARY OF THE INVENTION

Figure 1:
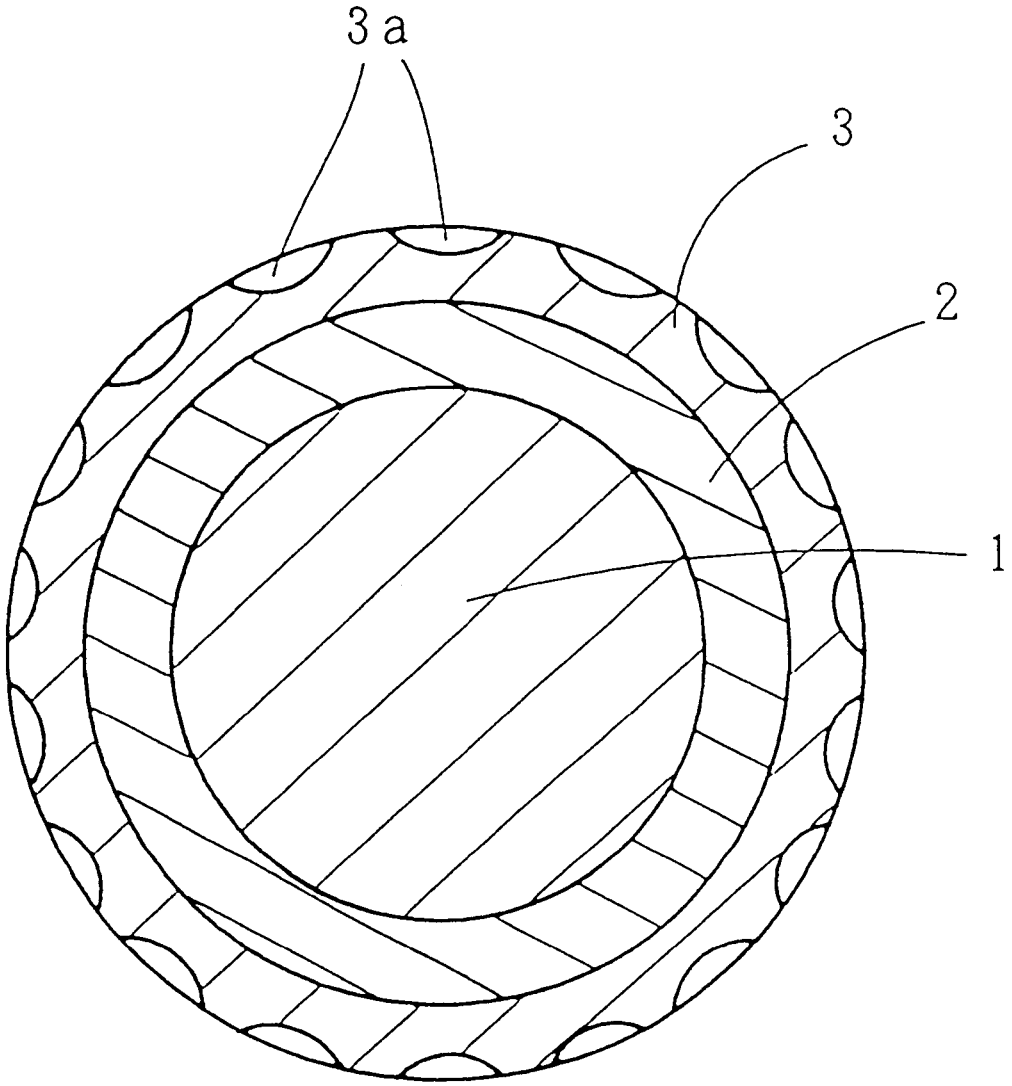
FIG. 1 is a schematic cross section illustrating one embodiment of the thread wound golf ball of the present invention.

The present invention provides a thread wound golf ball comprising a center composed of a vulcanized molded article of a rubber composition, a thread rubber layer formed on the center and a cover covering the thread rubber layer, wherein the center has a diameter of from 30 to 38 mm and a deformation amount, formed by applying an initial load of 10 kg to a final load of 30 kg to the center, of from 1 to 2.5 mm and, the cover is formed from a heated mixture of an ionomer resin, an maleic anhydride-modified thermoplastic resin and an epoxidated thermoplastic resin having a JIS-A hardness of 30 to 90.

DETAILED DESCRIPTION OF THE INVENTION

In the present invention, since the diameter of the center is adjusted to the range larger than that of a conventional one, i.e. 30 to 38 mm, and the deformation amount formed by applying an initial load of 10 Kg to a final load of 30 Kg to the center is adjusted within the range of 1 to 2.5 mm, spin amount decreases at the time of hitting and launch angle is high. Therefore, the flight distance is larger than that of a conventional thread wound golf ball, thereby obtaining a flight performance which is close to that of the two-piece solid golf ball.

Regarding the cover, a maleic anhydride-modified thermoplastic resin as a soft component is blended with an ionomer resin and, therefore, the ionomer resin is softened and shot feel and controllability are improved. Since a soft epoxidated thermoplastic resin is added to the above ionomer resin and maleic anhydride-modified thermoplastic resin and the resins are mixed with heating, an epoxy group of the epoxidated thermoplastic resin is reacted with a free carboxyl group in the ionomer resin and the maleic anhydride in the maleic anhydride-modified thermoplastic resin by the above mixing with heating uniform dispersion of the maleic anhydride-modified thermoplastic resin as the soft resin into the ionomer resin is thereby achieved. Thus, the degradation of excellent flight performance (rebound characteristics) and cut resistance of the ionomer resin is inhibited.

In the present invention, the ionomer resin used for constituting the cover are those obtained by using a copolymer of 80 to 90% by weight of an α-olefin (e.g. ethylene, etc.) and 5 to 20% by weight of an α,β-unsaturated carboxylic acid having 3 to 8 carbon atoms (e.g. acrylic acid, methacrylic acid, etc.), or a terpolymer of 70 to 85% by weight of an α-olefin (e.g. ethylene, etc.), 5 to 20% by weight of an α,β-unsaturated carboxylic acid having 3 to 8 carbon atoms (e.g. acrylic acid, methacrylic acid, etc.) and 10 to 25% by weight of an α,β-unsaturated carboxylic acid having 2 to 22 carbon atoms (e.g. acrylate, etc.) as a base polymer and neutralizing a part of the carboxyl groups in the base polymer with a metal ion (e.g. sodium ion, lithium ion, zinc ion, magnesium ion, potassium ion, etc.).

These ionomer resins are commercially available, for example, various ionomer resins available from Mitsui Du Pont Polychemical Co., Ltd. under the trade name of "Hi-milan", ionomer resins commercially available from Du Pont Co. under the trade name of "Surlyn" and ionomer resin commercially available from Exxon Co. under the trade name of "lotek", respectively.

Examples of the ionomer resins will be shown by the trade name. Examples of those commercially available from Mitsui Du Pont Polychemical Co., Ltd. include Hi-milan 1605, (Na), Hi-milan 1707 (Na), Hi-milan AM7318, (Na), Hi-milan 1555 (Na), Hi-milan 1706 (Zn), Hi-milan AM7315 (Zn), Hi-milan AM7317 (Zn), Hi-milan 1557 (Zn), Hi-milan AM7311 (Mg), Hi-milan MK7320 (K), etc.; terpolymer ionomer resins such as Hi-milan 1856 (Na), Hi-milan 1855 (Zn), Hi-milan AM7316 (Zn), etc. Examples of those commercially available from Du Pont Co. include ionomer resins such as Surlyn 8920 (Na), Surlyn 8940 (Na), Surlyn AD8512 (Na), Surlyn 9910 (Zn), Surlyn AD8511 (Zn), Surlyn 7930 (Li), Surlyn 7940 (Li), etc.; terpolymer ionomer resins such as Surlyn AD8265 (Na), Surlyn AD8269 (Na), etc. Examples of those commercially available from Exxon chemical Co. include ionomer resins such as lotek 7010 (Zn), lotek 8000 (Na), etc. These are used alone or in combination thereof. The Na, Zn, K, Li, Mg, etc., which are described in parentheses at the back of the trade name of the above ionomer resin show neutralization metal ion species, respectively. The above ionomer resins are illustrative and not restrictive.

As the maleic anhydride-modified thermoplastic resin, for example, various grades of maleic anhydride adducts of hydrogenated styrene-butadiene-styrene block copolymers are commercially available from Asahi Kasei Industries Co., Ltd. under the trade name of "Taftek M series". In addition, various grades of ethylene-ethyl acrylate-maleic anhydride terpolymers are commercially available from Sumitomo Chemical Industries Co., Ltd. under the trade name of "Bondine" and those obtained by graft-modifying ethylene-ethyl acrylate copolymers with maleic anhydride are commercially available from Mitsui Du Pont Polychemical Co., Ltd. under the trade name of "AR series". These are used alone or in combination thereof.

The maleic anhydride-modified thermoplastic resin is formulated for softening of the ionomer resin, and the flexural modulus is about 1 to 100 MPa, which is lower than that of the ethylene-acrylic acid copolymer or ethylene-methacrylic acid copolymer ionomer resin (flexural modulus of these ionomer resins is about 250–350 MPa.

As the epoxidated thermoplastic resin having a JIS-A hardness of 30 to 90, for example, glycidyl methacrylate adducts of hydrogenated styrene-butadiene-styrene block copolymers are commercially available from Asahi Kasei Industries Co., Ltd. under the trade name of "Taftek Z513" and "Taftek Z514", and various grades of epoxy-modified resins of styrene-butadiene copolymers are commercially available from Daicel Chemical Industries, Ltd. under the trade name of "ESBS AT series". These are used alone or in combination thereof. In the present invention, the epoxidated thermoplastic resin is limited to that having a JIS-A hardness of 30 to 90. When the JIS-A hardness of the epoxidated thermoplastic resin is lower than 30, flight performance is degraded. On the other hand, when the JIS-A hardness of the epoxidated thermoplastic resin is higher than 90, shot feel and controllability are not sufficiently improved. The JIS-A hardness refers to a hardness measured by a JIS-A type hardness tester which is corresponding to Shore A.

In the present invention, it is possible to obtain a desired performance by mixing the above three kinds of resins with heating. They are generally mixed with heating at 150 to 260° C. for 0.5 to 15 minutes, using internal mixers such as kneading type twin-screw extruder, Banbury, kneader, etc. It is sufficient that a water content required to the reaction between the maleic anhydride and glycidyl group is trace amounts of water contained in the resin. The resins may be mixed with heating by optionally adding about 0.1 to 0.2% by weight of water.

In the present invention, the mixing proportion of the above ionomer resin, maleic anhydride-modified thermoplastic resin and epoxidated thermoplastic resin having a JIS-A hardness of 30 to 90 is preferably as follows. That is, the proportion of the ionomer resin, maleic anhydride-modified olefin copolymer and epoxidated thermoplastic resin having a JIS-A hardness of 30 to 90 is from 30 to 70% by weight, from 10 to 69.5% by weight and from 5 to 20% by weight, respectively. That is, when the mixing proportion of the ionomer resin is smaller than the above range, flight performance and cut resistance are poor. On the other hand, when the mixing proportion of the ionomer resin is larger than the above range, shot feel and controllability are not sufficiently improved. When the mixing proportion of the maleic anhydride-modified thermoplastic resin is smaller than the above range, shot feel and controllability are not sufficiently improved. On the other hand, when the mixing proportion of maleic anhydride-modified thermoplastic resin is larger than the above range, flight performance is poor. When the mixing proportion of the epoxidated thermoplastic resin is smaller than the above range, flight performance is poor. On the other hand, when the mixing proportion of epoxidated thermoplastic resin is larger than the above range, flight performance is also poor due to the decrease of mixing proportion of the ionomer resin.

Various additives such as pigments (e.g. titanium dioxide, barium sulfate, etc.), dispersants, antioxidants, UV absorbers, photostabilizers, etc. can be optionally formulated in the cover composition used for forming the cover in the present invention, in addition to the base resin of a heated mixture of the above three sorts of resins.

It is preferred that the flexural modulus of the cover composition is within the range from 100 to 250 MPa. When the flexural modulus of the cover composition is lower than 100 MPa, the cover is too soft and spin amount is too large. Therefore, flight distance is lowered and cut resistance is poor. On the other hand, when the flexural modulus of the cover composition is higher than 250 MPa, it is impossible to obtain a suitable backspin amount and, therefore, controllability is degraded and shot feel also is poor. In the present invention, the flexural modulus of the cover composition constituting the cover is used in place of the flexural modulus of the cover. The reason is as follows. That is, once the golf ball is produced, the flexural modulus of the cover of the golf ball can not be measured by current techniques and, therefore, the measurement of the flexural modulus must be conducted after producing a sample from the cover composition. In such way, the flexural modulus of the cover of the golf ball can not be conducted, but the flexural modulus of the cover and that of the cover composition are substantially the same. The cover composition may contain a small amount of additives such as pigment. Therefore, it is considered that the flexural of the cover composition and that of the resin mixture, i.e. heated mixture of the ionomer resin, maleic anhydride-modified thermoplastic resin and epoxidated thermoplastic resin having a JIS-A hardness of 30 to 90 are substantially the same.

In the present invention, the diameter of the center is adjusted within the range from 30 to 38 mm, preferably (32) to (36) mm, and the deformation amount, formed by applying an initial load of 10 Kg to a final load of 30 Kg to the center, is adjusted within the range from 1 to 2.5 mm, preferably (1.1) to (2.0) mm. This is because the flight distance increases by inhibiting the spin amount at the time of hitting and increasing the launch angle.

When the diameter of the center is smaller than 30 mm, the thickness of the thread rubber layer is large. As a result, the launch angle is small and the spin amount is large. On the other hand, when the diameter of the center is larger than 38 mm, the thickness of the thread rubber layer is small and winding of the thread rubber is finished before a tension is applied and, therefore, it is impossible to obtain a proper hardness required for the golf ball.

When the deformation amount of the center is larger than 2.5 mm, the thread rubber must be tightly wound so as to obtain a proper ball hardness because of a soft center. As a result, the tension of the thread wound layer is too large and deformation at the time of hitting does not readily occur and, therefore, the desired improvement of the flight distance is not accomplished. On the other hand, when the deformation amount of the center is smaller than 1 mm under the above conditions, the center is too hard and shot feel is poor.

When the center is dropped on a concrete plate from the height of 254 cm, the height of rebound is preferably not less than 120 cm, particularly from 140 to 240 cm. That is, the fact that the center has such a large height of rebound shows that the impact resilience is high. When the center has such a high impact resilience, the ball velocity at the time of hitting is large and it is possible to obtain excellent flight performance.

The center is obtained, for example, by vulcanization-molding a rubber composition wherein 5 to 80 parts by weight (preferably 15 to 50 parts by weight) of a thermoplastic resin as a filler for adjusting a hardness, 2 to 12 parts by weight (preferably 6 to 10 parts by weight) of sulfur, 1 to 4 parts by weight (preferably 1 to 2 parts by weight) of a vulcanization accelerator and 10 to 150 parts by weight (preferably 50 to 120 parts by weight) of a weight adjustor and, if necessary, 3 to 10 parts by weight (preferably 5 to 9 parts by weight) of a vulcanization aid is further formulated, based on 100 parts by weight of the rubber, or vulcanization-molding a rubber composition wherein 4 to 25 parts by weight (preferably 5 to 15 parts by weight) of an α,β-unsaturated carboxylic acid metal salt, 0.5 to 3 parts by weight (0.8 to 2 parts by weight) of an initiator and 20 to 100 parts by weight (preferably 35 to 75 parts by weight) of a weight adjustor are formulated, based on 100 parts by weight of the rubber.

In the present invention, the center is obtained by a method comprising formulating the thermoplastic resin as the filler for adjusting hardness into a rubber composition and then sulfur vulcanizing it in a mold, or a method comprising formulating the α,β-unsaturated carboxylic acid metal salt into a rubber composition and then vulcanizing without sulfur. In the method of sulfur vulcanizing, the vulcanization molding is generally conducted by molding at 140 to 170° C., preferably 150 to 160° C., under pressure for 5 to 30 minutes, preferably 10 to 20 minutes. In the latter method of vulcanizing using the α,β-unsaturated carboxylic acid metal salt, the vulcanization molding is generally conducted by molding at 140 to 180° C. under pressure for 10 to 40 minutes.

The rubber component used for the center is not specifically limited, and polybutadiene (particularly high-cis polybutadine) having high rebound characteristics is preferred. In the preparation of the rubber composition for the center, high-cis polybutadiene is preferably used as the rubber component or high-cis polybutadine is preferably used as a main component of the rubber composition. This rubber can be used for preparing the rubber composition for the method of sulfur vulcanizing and rubber composition for the method of vulcanizing using the α,β-unsaturated carboxylic acid metal salt.

Next, the components of the rubber composition for the method of sulfur vulcanizing will be explained in detail.

The thermoplastic resin includes high-molecular weight polyolefin (e,g, high-styrene resin, high-molecular weight polyethylene, high-molecular weight polypropylene, etc.) and a mixture thereof. The rubber composition of the center differs from a conventional rubber composition for the center in formulating the thermoplastic resin as the filler for adjusting hardness of the center.

The amount of the thermoplastic resin formulated may be from 5 to 80 parts by weight, preferably from 15 to 50 parts by weight, based on 100 parts by weight of the rubber, as described above. When the amount of the thermoplastic resin formulated is smaller than the above range, it is difficult to increase the hardness of the center to a proper hardness. Therefore, the hardness of the center is the same as that of a conventional center and it is impossible to obtain the desired improvement of the flight distance. On the other hand, when the amount of the thermoplastic resin formulated is larger than the above range, hardness is too high and shot feel is poor. In addition, the workability at the time of rubber kneading is also poor.

An amount of sulfur formulated may be from 2 to 12 parts by weight, preferably from 6 to 10 parts by weight, based on 100 parts by weight of the rubber component. When the amount of sulfur is smaller than the above range, the vulcanization degree is low and it is difficult to adjust the hardness of the center to a proper hardness. On the other hand, when the amount of sulfur formulated is larger than the above range, the hardness of the center is high and shot feel is poor.

The vulcanization aid includes metal oxides (e.g. zinc oxide, magnesium oxide, etc.) and higher fatty acids (e.g. stearic acid, palmitic acid, oleic acid, lauric acid, etc.). This vulcanization aid is preferably used for the purpose of smoothly proceeding with the vulcanization, but is not necessarily required.

The vulcanization accelerator may be any one which can be used as a conventional sulfur vulcanizing vulcanization accelerator. Typical examples of the vulcanization accelerator are thiazole vulcanization accelerators such as 2-mercaptobenzothiazole, dibenzothiazyl disulfide, etc.; thiuram vulcanization accelerators such as tetramethylthiuram monosulfide tetramethyltiuram disulfide, etc.; and sulfenamide vulcanization accelerators such as N-cyclohexyl-2-benzothiazyl sulfenamide, etc., but are not limited thereto.

The vulcanization aid and vulcanization accelerator are generally formulated according to the amount of sulfur formulated. An amount of the vulcanization aid is from 3 to 10 parts by weight, preferably from 5 to 9 parts by weight, based on 100 parts by weight of the rubber. An amount of the vulcanization accelerator is from 1 to 4 parts by weight, preferably from 1 to 2 parts by weight, based on 100 parts by weight of the rubber. When these amounts are smaller than the above range, it is difficult to sufficiently proceed sulfur vulcanization. On the other hand, when the amounts are larger than the above range, the hardness of the center is too high and, therefore, the shot feel is poor.

As the weight adjustor, for example, barium sulfate, clay, calcium carbonate, silica filler, etc. are used. An amount of the weight adjustor formulated may be from 10 to 150 parts by weight, preferably from 50 to 120 parts by weight, based on 100 parts by weight of the rubber, as described above. When the amount of the weight adjustor is smaller than the above range, the weight of the center decreases and it is difficult to obtain a proper weight of the golf ball. On the other hand, when the amount of the weight adjustor formulated is larger than the above range, the weight of the center increases and the ball weight exceeds specifications.

Next, the components of the rubber composition for the method of vulcanizing using the α,β-unsaturated carboxylic acid metal salt will be explained.

The α,β-unsaturated carboxylic acid metal salt includes metal acrylates (e.g. zinc acrylate, magnesium acrylate, etc.) and metal methacrylates (e.g. zinc methacrylate, magnesium methacrylate, etc.). It can be used alone or in combination thereof.

The α,β-unsaturated carboxylic acid metal salt has an action of crosslinking the rubber. An amount of the α,β-unsaturated carboxylic acid metal salt is from 4 to 25 parts by weight, preferably from 5 to 15 parts by weight, based on 100 parts by weight of the rubber. When the amount of the α,β-unsaturated carboxylic acid metal salt is smaller than the above range, the center is soft and the deformation amount of the center is larger than 2.5 mm. Therefore, it is difficult to obtain the desired improvement of the flight distance, as described above. On the other hand, when the amount of the α,β-unsaturated carboxylic acid metal salt is larger than the above range, the center is too hard and the deformation amount of the center is smaller than 1 mm and, therefore, the shot feel is poor. Since the α,β-unsaturated carboxylic acid metal salt contains no sulfur, sulfur does not take part in crosslinking. Since a crosslinking action of the α,β-unsaturated carboxylic acid metal salt is generally referred to as "vulcanization" in the rubber industry, it is also referred to as "vulcanization" in the present invention according to precedent.

Examples of the initiator are organic peroxides such as dicumyl peroxide, 1,1-bis(t-butylperoxy) 3,3,5-trimethylcyclohexane, etc. Among them, dicumyl peroxide is particularly preferred.

An amount of the initiator formulated is from 0.5 to 3 parts by weight, preferably from 0.8 to 2 parts by weight, based on 100 parts by weight of the rubber. When the amount of the initiator is smaller than the above range, it is difficult to sufficiently vulcanize. Therefore, the center is soft and it is difficult to obtain the desired improvement of the flight distance, as described above. On the other hand, when the amount of the initiator is larger than the above range, the center is too hard and shot feel is poor.

As the weight adjustor, for example, zinc oxide, barium sulfate, calcium carbonate, barium carbonate, clay, silica filler, etc. may be used.

An amount of the weight adjustor formulated is from 20 to 100 parts by weight, preferably from 35 to 75 parts by weight, based on 100 parts by weight of the rubber, as described above. When the amount of the weight adjustor is smaller than the above range, the weight of the center decreases and it is difficult to obtain a proper weight of the golf ball. On the other hand, when the amount of the weight adjustor is larger than the above range, the weight of the center is increased and the ball weight is excessive.

It is possible to appropriately contain antioxidants, vulcanization adjustors, softening agents, etc. in the rubber composition of the center, in addition to the above components.

According to the present invention, the thread rubber layer is formed by winding a thread rubber around the center in the stretched state. The thread rubber used for forming the thread rubber layer can be the same one which has hitherto been used. Examples thereof are those obtained by vulcanizing a rubber composition wherein sulfur, a vulcanization aid, a vulcanization accelerator, an antioxidant, etc. are formulated in a natural rubber or the natural rubber and synthetic polyisoprene.

A thread wound golf ball can be obtained by covering a cover composition, comprising a heated mixture of the above ionomer resin, maleic anhydride-modified thermoplastic resin and epoxidated thermoplastic resin having a JIS-A hardness of 30 to 90 around the thread rubber layer of the thread wound core which is composed of the center and the thread rubber layer.

A method of covering the cover on the core is not specifically limited, and thus may be a conventional method. For example, there can be used a method comprising molding the cover composition into a semi-spherical half-shell in advance, covering a core with two half-shells and then subjecting to a pressure molding at 130 to 170° C. for 1 to 5 minutes, or a method comprising injection-molding the cover composition directly to cover the core. The thickness of the cover may be from about 1 to 3 mm. In case of the cover molding, a dimple may be optionally formed on the surface of the ball. Further, a paint or marking may be optionally provided after cover molding.

One embodiment of the thread wound golf ball of the present invention will be explained with reference to the accompanying drawing. FIG. 1 is a schematic cross section illustrating one embodiment of the thread wound golf ball of the present invention. In FIG. 1, 1 is a center, 2 is a thread rubber layer, 3 is a cover and 3*a* is a dimple.

The center 1 is composed of a vulcanized molded article of the rubber composition. The diameter thereof is from 30 to 38 mm and the deformation amount formed by applying an initial load of 10 Kg to a final load of 30 Kg is within the range from 1 to 2.5 mm.

The thread rubber layer 2 is formed by winding the thread rubber around the center 1 in the stretched state, and a so-called thread wound core is formed of the center and thread rubber layer 2.

The cover 3 is formed by covering the cover composition, comprising the above specific heated mixture as the base resin, around the thread rubber layer 2 of the thread wound core, and suitable number of dimples 3*a* are optionally provided on the surface of the cover 2 according to the desired characteristics.

As described above, according to the present invention, there is provided a thread wound golf ball having good shot feel and controllability as well as excellent flight performance.

EXAMPLES

The following Examples and Comparative Examples further illustrate the present invention in detail but are not to be construed to limit the scope thereto.

Examples 1 to 8 and Comparative Examples 1 to 9

Thread wound golf balls of Examples 1 to 8 and Comparative Examples 1 to 9 were produced through the following steps (1) to (4).

(1) Production of center

A rubber composition for center was prepared according to the composition shown in Table 1 and Table 2, and then the resulting rubber composition was charged in a mold for center and vulcanized by molding with heating at 155° C. under pressure for 20 minutes to produce a center.

The diameter, JIS-A hardness (hardness measured by a JIS-A hardness tester), deformation amount, height of rebound and weight of the resulting center were measured. The results are shown in Table 1 and Table 2.

An amount of each formulation component shown in the tables is represented by parts by weight, and it is also the same in the following tables. The rubber compositions for center of Preparation Examples 1 to 3 used for the thread wound golf balls of Examples 1 to 8 as well as diameter, JIS-A hardness, deformation amount, height of rebound and weight of the resulting center are mainly shown in Table 1. The rubber compositions for center of Comparative Preparation Examples 1 to 3 used for the thread wound golf balls of Comparative Examples 1 to 9 as well as diameter, JIS-A hardness, deformation amount, height of rebound and weight of the resulting center are mainly shown in Table 2. The measuring method of the deformation amount and height of rebound are as shown below, and the formulation components will be explained at the back of Table 2.

Deformation amount:

A deformation amount formed by applying an initial load of 10 Kg to a final load of 30 Kg to the center is measured.

Height of rebound:

A center is dropped on a concrete plate from the height of 254 cm and a height of rebound is measured.

TABLE 1

| | | Preparation Example No. | | |
|---|---|---|---|---|
| | | 1 | 2 | 3 |
| Rubber composition for center: | | | | |
| JSR BR11 | *1 | 100 | 100 | 100 |
| Nippol 2007J | *2 | 30 | 30 | 0 |
| Miperon XM-220 | *3 | 0 | 0 | 30 |
| Sulfur | | 10 | 10 | 10 |
| Vulcanization aid | *4 | 7 | 7 | 7 |
| Vulcanization accelerator | *5 | 1.5 | 1.5 | 1.5 |
| Weight adjustor | *6 | 90 | 70 | 90 |
| Physical properties of center | | | | |
| Diameter (mm) | | 30.3 | 32.4 | 31.2 |
| JIS-A hardness | | 86 | 87 | 86 |
| Deformation amount (mm) | | 1.95 | 2.00 | 1.90 |
| Height of rebound (cm) | | 200 | 196 | 210 |
| Weight (g) | | 20.4 | 23.2 | 22.1 |

TABLE 2

| | | Comparative Preparation Example No. | | |
|---|---|---|---|---|
| | | 1 | 2 | 3 |
| Rubber composition for center: | | | | |
| JSR BR11 | *1 | 100 | 100 | 100 |
| Nippol 2007J | *2 | 30 | 0 | 30 |
| Miperon XM-220 | *3 | 0 | 0 | 0 |
| Sulfur | | 10 | 15 | 10 |
| Vulcanization aid | *4 | 7 | 7 | 7 |
| Vulcanization accelerator | *5 | 1.5 | 1.5 | 1.5 |
| Weight adjustor | *6 | 83 | 65 | 33 |
| Physical properties of center | | | | |
| Diameter (mm) | | 28.2 | 31.2 | 38.2 |
| JIS-A hardness | | 86 | 85 | 86 |
| Deformation amount (mm) | | 3.17 | 2.65 | 3.35 |
| Height of rebound (cm) | | 216 | 210 | 205 |
| Weight (g) | | 17.5 | 22.0 | 34.0 |

*1: Trade name, high-cis polybutadiene (content of 1,4-cis-polybutadiene: 96%) manufactured by Japan Synthetic Rubber Co., Ltd.

*2: Trade name, high-styrene resin manufactured by Nihon Zeon Co., Ltd.

*3: Trade name, high-molecular weight polyethylene manufactured by Mitsui Petrochemical Industries Co., Ltd.

*4: Zinc white Ginryo R [trade name, zinc oxide manufactured by Toho Aen Co., Ltd.] 5 parts by weight, stearic acid [manufactured by Nippon Oil & Fats Co., Ltd.] 2 parts by weight

*5: Nocceler TT [trade name, tetramethylthiuram disulfide manufactured by Ohuchi Shinko Kagaku Kogyo Co., Ltd.] 0.25 parts by weight, Nocceler CZ-G [trade name, N-cyclohexyl-2-benzothiazyl sulfenamide manufactured by Ohuchi Shinko Kagaku Kogyo Co., Ltd.] 1.25 parts by weight

*6: Barium sulfate [manufactured by Sakai Kagaku Kogyo Co., Ltd.]

(2) Production of thread wound core

A thread rubber layer was formed by winding a thread rubber whose base rubber was composed of a natural rubber/low cis-synthesized polyisoprene (weight ratio: 50/50) [Shell IR-309 (trade name), manufactured by Shell Chemical Co.] in the stretched state around the center obtained in the above item (1), and a thread wound core having an outer diameter of 39.5 mm was produced.

(3) Preparation of cover composition

A formulation material having the composition shown in Table 3 and Table 4 was mixed using a twin-screw kneading type extruder to obtain a pelletized cover composition. The extrusion conditions are as follows: a screw diameter: 45 mm; a screw revolution per minute: 200 rpm; a screw L/D: 35. The formulation components were heated at 220 to 260° C. at the die position of the extruder.

The flexural modulus of the resulting cover composition was measured. The results are shown in Table 3 and Table 4. The measuring method of the flexural modulus is as follows.

Flexural modulus:

It is measured according to ASTM D-747 after a sheet having a thickness of about 2 mm obtained by heat-press molding was preserved at 23° C. for two weeks.

The composition and flexural modulus of the compositions for cover of Preparation Examples 1 to 6 used for the thread wound golf balls of Examples 1 to 8 are shown in Table 3, and the composition and flexural modulus of the compositions for cover of Comparative Preparation Examples 1 to 6 used for the thread wound golf balls of Comparative Examples 1 to 9 are shown in Table 4. The details of the formulation components represented by the trade name will be explained at the back of Table 4.

TABLE 3

| | | Preparation Example No. | | | | | |
|---|---|---|---|---|---|---|---|
| | | 1 | 2 | 3 | 4 | 5 | 6 |
| Hi-milan 1605 | *7 | 20 | 15 | 20 | 0 | 0 | 0 |
| Hi-milan 1706 | *8 | 20 | 15 | 20 | 0 | 0 | 0 |
| Hi-milan 1855 | *9 | 30 | 40 | 30 | 20 | 30 | 30 |
| Surlyn AD8511 | *10 | 0 | 0 | 0 | 20 | 20 | 20 |
| Surlyn AD8512 | *11 | 0 | 0 | 0 | 20 | 20 | 20 |
| Bondine AX8390 | *12 | 15 | 0 | 0 | 0 | 0 | 0 |
| Taftek M1943 | *13 | 0 | 20 | 0 | 30 | 0 | 0 |
| AR-201 | *14 | 0 | 0 | 20 | 0 | 20 | 20 |
| Taftek Z514 | *15 | 15 | 10 | 10 | 10 | 10 | 0 |
| ESBS AT014 | *16 | 0 | 0 | 0 | 0 | 0 | 10 |
| Titanium dioxide | | 2 | 2 | 2 | 2 | 2 | 2 |
| Barium sulfate | | 2 | 2 | 2 | 2 | 2 | 2 |
| Flexural modulus (MPa) | | 135 | 120 | 130 | 120 | 135 | 130 |

TABLE 4

| | | Comparative Preparation Example No. | | | | | |
|---|---|---|---|---|---|---|---|
| | | 1 | 2 | 3 | 4 | 5 | 6 |
| Hi-milan 1605 | *7 | 50 | 25 | 20 | 25 | 20 | Balata |
| Hi-milan 1706 | *8 | 50 | 25 | 20 | 25 | 20 | *18 |
| Hi-milan 1855 | *9 | 0 | 40 | 40 | 35 | 30 | |
| Bondine AX8390 | *12 | 0 | 10 | 0 | 0 | 0 | |
| Taftek M1943 | *13 | 0 | 0 | 20 | 0 | 0 | |
| AR-201 | *14 | 0 | 0 | 0 | 15 | 0 | |
| Neucrel AN4212C | *17 | 0 | 0 | 0 | 0 | 30 | |
| Titanium dioxide | | 2 | 2 | 2 | 2 | 2 | |
| Barium sulfate | | 2 | 2 | 2 | 2 | 2 | |
| Flexural modulus (MPa) | | 340 | 170 | 150 | 170 | 150 | 240 |

*7: Trade name, ethylene-methacrylic acid copolymer ionomer resin obtained by neutralizing with a sodium ion, manufactured by Mitsui Du Pont Polychemical Co., Ltd., Ml (melt index): 2.8, flexural modulus: 310 MPa

*8: Trade name, ethylene-methacrylic acid copolymer ionomer resin obtained by neutralizing with a zinc ion, manufactured by Mitsui Du Pont Polychemical Co., Ltd., Ml: 0.8, flexural modulus: about 260 MPa,

*9: Trade name, ethylene-butyl acrylate-methacrylic acid terpolymer ionomer resin obtained by neutralizing with a zinc ion, manufactured by Mitsui Du Pont Polychemical Co., Ltd., Ml: 1.0, flexural modulus: about 90 MPa

*10: Trade name, ethylene-methacrylic acid copolymer ionomer resin obtained by neutralizing with a zinc ion, manufactured by Mitsui Du Pont Polychemical Co., Ltd., Ml: 3.4, flexural modulus: about 220 MPa

*11: Trade name, ethylene-methacrylic acid copolymer ionomer resin obtained by neutralizing with a sodium ion, manufactured by Mitsui Du Pont Polychemical Co., Ltd., Ml: 4.4, flexural modulus: about 280 MPa

*12: Trade name, ethylene-ethyl acrylate-maleic anhydride terpolymer, manufactured by Sumitomo Chemical Industries Co., Ltd., Ml: 7.0, flexural modulus <10 MPa, content of ethyl acrylate+maleic anhydride=32% (content of maleic anhydride: 1 to 4%)

*13: Trade name, maleic anhydride adduct of styrene-butadiene-styrene block copolymer, manufactured by Asahi Kasei Industries Co., Ltd., JIS-A hardness: 67, content of styrene : about 20% by weight

*14: Trade name, product obtained by graft-modifying ethylene-ethyl acrylate copolymer obtained with maleic anhydride, manufactured by Mitsui Du Pont Polychemical Co., Ltd., JIS-A hardness: 51

*15: Trade name, glycidyl methacrylate adduct of styrene-butadienestyrene block copolymer, manufactured by Asahi Kasei Industries Co., Ltd., JIS-A hardness: 84, content of styrene: about 30% by weight, content of butadiene: about 70% by weight, content of glycidyl methacrylate: about 1% by weight

*16: Trade name, epoxy-modified product of styrene-butadiene block copolymer, manufactured by Daiseru Chemical Industries Co., JIS-A hardness: 70, content of styrene: about 40% by weight

*17: Trade name, ethylene-isobutyl acrylate-methacrylic acid terpolymer ionomer resin, manufactured by Du Pont Co., Ltd., Ml: 5.0, flexural modulus: about 17 MPa

*18: Normal composition for balata cover comprising transpolyisoprene as a main material (4) Production of thread wound golf ball A thread wound golf ball having an outer diameter of 42.8 mm was obtained by molding a semi-spherical half-shell from the cover composition of the above item (3), covering the core of the item (2) with two half-shells, followed by press molding in a mold for golf ball and further painting.

The ball weight, ball compression, ball initial velocity and flight distance (carry) of the resulting thread wound golf ball were measured. The ball compression was measured by PGA method, and the ball initial velocity was measured by R & A initial velocity measuring method. The flight distance was determined by hitting the thread wound golf ball with a No. 1 wood club at a head speed of 45 m/second, using a swing robot manufactured by True Temper Co, and measuring the distance to the dropped point.

The shot feel and the controllability of the resulting golf ball were evaluated by 10 top professional golfers according to a practical hitting test. The evaluation criteria are as follows. The results shown in the Tables below are based on the fact that not less than 8 out of 10 professional golfers evaluated with the same criterion about each test item. The shot feel was evaluated by practically hitting with a No. 1 wood club, and the controllability was evaluated by practically hitting with an iron club.

Shot feel

○: Good, small impact force and soft feel

X: Poor

Controllability

○: Good, spin i s easily put on a golf ball using an iron club and the golf ball is easily stopped.

X: Poor

The ball weight, ball compression, ball initial velocity, flight distance, shot feel and controllability of the golf balls of Examples 1 to 4 as well as kind of the composition for center and cover composition used in the production of the golf ball are shown in Table 5. Those of the golf balls of Examples 5 to 8, those of the golf balls of Comparative Examples 1 to 5 and those of the golf balls of Comparative Examples 6 to 9 are shown in Tables 6, 7 and 8, respectively. The center and cover composition are represented by their Preparation Example No. and Comparative Preparation Example No.

TABLE 5

| | Example No. | | | |
|---|---|---|---|---|
| | 1 | 2 | 3 | 4 |
| Composition for center | Preparation Example 2 | Preparation Example 2 | Preparation Example 1 | Preparation Example 2 |
| Cover composition | Preparation Example 1 | Preparation Example 2 | Preparation Example 3 | Preparation Example 3 |
| Ball weight (g) | 45.4 | 45.3 | 45.4 | 45.3 |
| Ball compression | 85 | 86 | 86 | 85 |
| Ball initial velocity (feet/second) | 252.8 | 252.9 | 252.6 | 252.7 |
| Flight distance (yard) | 228 | 230 | 228 | 229 |
| Shot feel | ○ | ○ | ○ | ○ |
| Controllability | ○ | ○ | ○ | ○ |

TABLE 6

| | Example No. | | | |
|---|---|---|---|---|
| | 5 | 6 | 7 | 8 |
| Composition for center | Preparation Example 3 | Preparation Example 2 | Preparation Example 2 | Preparation Example 2 |
| Cover composition | Preparation Example 3 | Preparation Example 4 | Preparation Example 5 | Preparation Example 6 |
| Ball weight (g) | 45.4 | 45.4 | 45.3 | 45.3 |
| Ball compression | 86 | 85 | 85 | 86 |
| Ball initial velocity (feet/second) | 252.8 | 252.9 | 252.9 | 252.8 |
| Flight distance (yard) | 228 | 230 | 229 | 227 |
| Shot feel | ○ | ○ | ○ | ○ |
| Controllability | ○ | ○ | ○ | ○ |

TABLE 7

| | Comparative Example No. | | | | |
|---|---|---|---|---|---|
| | 1 | 2 | 3 | 4 | 5 |
| Composition for center | Comparative Preparation Example 2 | Comparative Preparation Example 1 | Comparative Preparation Example 3 | Preparation Example 2 | Preparation Example 2 |
| Cover composition | Preparation Example 2 | Preparation Example 2 | Preparation Example 2 | Comparative Preparation Example 1 | Comparative Preparation Example 2 |
| Ball weight (g) | 45.3 | 45.4 | 45.4 | 45.3 | 45.4 |
| Ball compression | 86 | 86 | 86 | 86 | 84 |
| Ball initial velocity (feet/second) | 251.7 | 251.3 | 251.2 | 252.7 | 250.8 |
| Flight distance (yard) | 222 | 223 | 222 | 229 | 222 |
| Shot feel | ○ | ○ | ○ | X | ○ |
| Controllability | ○ | ○ | ○ | X | ○ |

TABLE 8

| | Comparative Example No. | | | |
|---|---|---|---|---|
| | 6 | 7 | 8 | 9 |
| Composition for center | Preparation Example 2 | Preparation Example 2 | Preparation Example 2 | Preparation Example 2 |
| Cover composition | Comparative Preparation Example 3 | Comparative Preparation Example 4 | Comparative Preparation Example 5 | Comparative Preparation Example 6 |

TABLE 8-continued

| | Comparative Example No. | | | |
|---|---|---|---|---|
| | 6 | 7 | 8 | 9 |
| Ball weight (g) | 45.4 | 45.4 | 45.3 | 45.4 |
| Ball compression | 83 | 84 | 84 | 84 |
| Ball initial velocity (feet/second) | 250.9 | 251.0 | 251.2 | 251.3 |
| Flight distance (yard) | 222 | 223 | 223 | 224 |
| Shot feel | ○ | ○ | ○ | ○ |
| Controllability | ○ | ○ | ○ | ○ |

As is apparent from the results of Tables 5 and 6, the golf balls of Examples 1 to 8 attained long flight distance of 227 to 230 yards, and showed excellent flight performance as well as good shot feel and controllability.

To the contrary, the golf ball of Comparative Example 1 showed good shot feel and controllability because of large deformation amount of the center, but the flight distance was short and the flight performance was not sufficient. The golf ball of Comparative Example 2 showed insufficient flight performance because of small diameter of the center and large deformation amount. The golf ball of Comparative Example 3 showed insufficient flight performance because of large diameter of the center and large deformation amount.

The golf ball of Comparative Example 4 was superior in flight performance because only high-rigid ionomer resin was used as the base resin for cover, but showed poor shot feel and controllability.

The golf balls of Comparative Examples 5 to 8 attained the flight distance which is 4 to 8 yards less than that of the golf balls of Examples 1 to 8, and showed insufficient flight performance. This is because no epoxidated thermoplastic resin is contained as the base resin for cover.

The results of the practical hitting test by professional golfers will be explained in detail as follows.

The golf balls of Examples 1 to 8 of the present invention have the shot feel and controllability, which are close to those of the golf ball covered with a balata cover of Comparative Example 9, and the flight distance reached a satisfactory level. However, the golf ball of Comparative Example 4 using only high-rigid ionomer resin as the base rubber for cover showed hard shot feel, poor ease of putting spin on the ball and poor controllability, while the golf balls of Comparative Examples 1 to 3 and Comparative Examples 5 to 8 were evaluated that the shot feel and controllability are good but the flight distance is poor.

In order to examine the cut resistance of the thread wound golf balls of Examples 1 to 8 and Comparative Examples 1 to 9, a pitching wedge was mounted to a swing robot manufactured by True Temper Co. and the top part of the golf ball was hit at a head speed of 30 m/second to examine whether a cut mark is formed or not.

As a result, no cut mark was formed on the thread wound golf balls of Examples 1 to 8 and Comparative Example 4 but a small cut mark was formed on the thread wound golf balls of Comparative Examples 1 to 3 and Comparative Example 5 to 8.

The cut resistance of the thread wound golf ball covered with the balata cover of Comparative Example 9 was also examined under the same conditions. As a result, a large cut mark, which is scarcely fit for use, is formed on the thread wound golf ball of Comparative Example 9.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A thread wound golf ball comprising a center composed of a vulcanized molded rubber composition, a thread rubber layer formed on the center and a cover covering the thread rubber layer, wherein the center has a diameter of from 30 to 38 mm and a deformation amount, formed by applying an initial load of 10 kg to a final load of 30 kg to the center, of from 1 to 2.5 mm and, the cover is formed from a heated mixture of an ionomer resin, a maleic anhydride-modified thermoplastic resin and an epoxidated thermoplastic resin having a JIS-A hardness of 30 to 90, wherein the epoxidated thermoplastic resin having a JIS-A hardness of 30 to 90 is at least one member selected from the group consisting of a glycidyl methacrylate adduct of hydrogenated styrene-butadiene-styrene block copolymer and an epoxy-modified resin of styrene-butadiene copolymer.

2. The thread wound golf ball according to claim 1, wherein in the cover, the ionomer resin is present in an amount of 30 to 70% by weight, the maleic anhydride-modified thermoplastic resin is present in an amount of 10 to 69.5% by weight and the epoxidated thermoplastic resin having a JIS-A hardness of 30 to 90 is present in an amount of from 5 to 20% by weight, based on the total weight of the three resins and the cover composition constituting the cover has a flexural modulus of from 100 to 250 MPa.

3. The thread wound golf ball according to claim 1, wherein a base polymer of the ionomer resin is at least one member selected from the group consisting of an ethylene-acrylic acid copolymer, an ethylene-methacrylic acid copolymer and an ethylene-methacrylic acid-acrylate ter-polymer.

4. The thread wound golf ball according to claim 1, wherein the maleic anhydride-modified thermoplastic resin is at least one member selected from the group consisting of a maleic anhydride adduct of hydrogenated styrene-butadiene-styrene block copolymer, an ethylene-ethyl acrylate-maleic anhydride terpolymer and one obtained by graft-modifying an ethylene-ethyl acrylate copolymer with maleic anhydride.

5. The thread wound golf ball according to claim 1, wherein the center is a vulcanized molded article of a rubber composition comprising 100 parts by weight of rubber, 5 to 80 parts by weight of at least one thermoplastic resin selected from the group consisting of styrene resin and high-molecular weight polyolefin, 2 to 12 parts by weight of sulfur, 1 to 4 parts by weight of a vulcanization accelerator and 10 to 150 parts by weight of a weight adjustor.

6. The thread wound golf ball according to claim 1, wherein the center is a vulcanized molded article of a rubber composition comprising 100 parts by weight of a rubber, 4 to 25 parts by weight of an $\alpha,\beta$-unsaturated carboxylic acid metal salt, 0.5 to 3 parts by weight of a polymerization initiator and 20 to 100 parts by weight of a weight adjustor.

7. The thread wound golf ball according to claim 1, wherein the rubber of the center is high-cis polybutadiene or one containing high-cis polybutadiene as a main component.

8. The tread wound golf ball according to claim 5, wherein the rubber of the center is high-cis polybutadiene or one containing high-cis polybutadiene as a main component.

9. The tread wound golf ball according to claim 6, wherein the rubber of the center is high-cis polybutadiene or one containing high-cis polybutadiene as a main component.

* * * * *